US005571981A

United States Patent [19]

Miyamoto

[11] Patent Number: 5,571,981

[45] Date of Patent: Nov. 5, 1996

[54] AUTOMATIC PERFORMANCE DEVICE FOR IMPARTING A RHYTHMIC TOUCH TO MUSICAL TONES

[75] Inventor: Hiromu Miyamoto, Hamamatsu, Japan

[73] Assignee: Yamaha Corporation, Japan

[21] Appl. No.: 402,149

[22] Filed: Mar. 10, 1995

[30] Foreign Application Priority Data

Mar. 11, 1994 [JP] Japan ..... 6-068007

[51] Int. Cl.[6] ..... A63H 5/00; G04B 13/00; G10H 7/00

[52] U.S. Cl. ..... 84/609; 84/634

[58] Field of Search ..... 84/609, 612, 634, 84/636

[56] References Cited

U.S. PATENT DOCUMENTS

| | | | |
|---|---|---|---|
| 4,506,580 | 3/1985 | Koike | 84/609 |
| 5,009,145 | 4/1991 | Ishida et al. | 84/612 |
| 5,235,125 | 8/1993 | Sato et al. | 84/609 |
| 5,410,097 | 4/1995 | Kato et al. | 84/610 |
| 5,453,569 | 9/1995 | Saito et al. | 84/609 |

FOREIGN PATENT DOCUMENTS

| | | |
|---|---|---|
| 62-183496 | 8/1987 | Japan . |
| 2-6480 | 2/1990 | Japan . |

*Primary Examiner*—William M. Shoop, Jr.
*Assistant Examiner*—Jeffrey W. Donels
*Attorney, Agent, or Firm*—Graham & James LLP

[57] ABSTRACT

An automatic performance device is comprised of a memory for storing automatic performance data including event data, and a CPU which reads out the automatic performance data from the memory and plays back the automatic performance data for generating musical tones. A plurality of event data which overlap in output timing for generating musical tones are detected from the readout automatic performance data, and when the plurality of event data which overlap in output timing for generating musical tones are detected, the output timing of at least one of the plurality of event data is shifted.

11 Claims, 15 Drawing Sheets

*FIG.9A* BEFORE SHIFTING
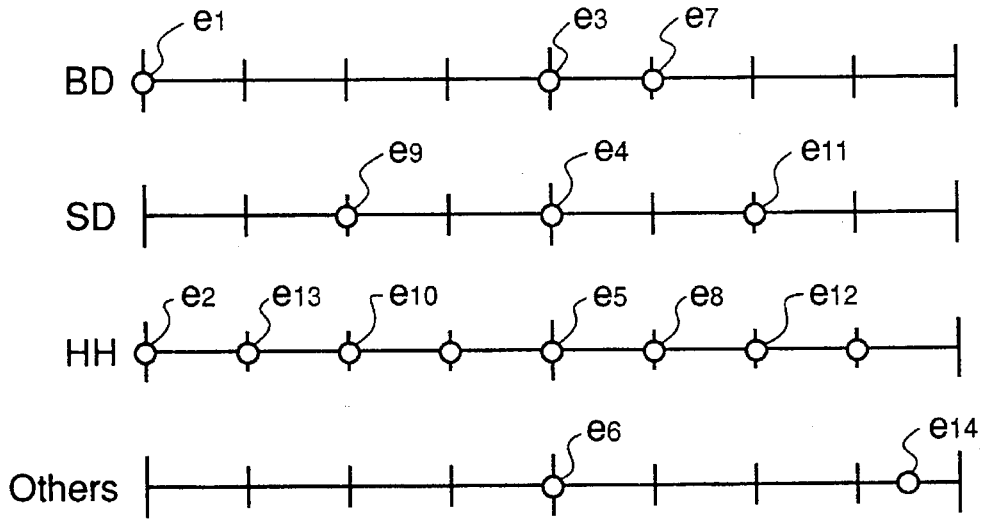
*FIG.9B* AFTER SHIFTING
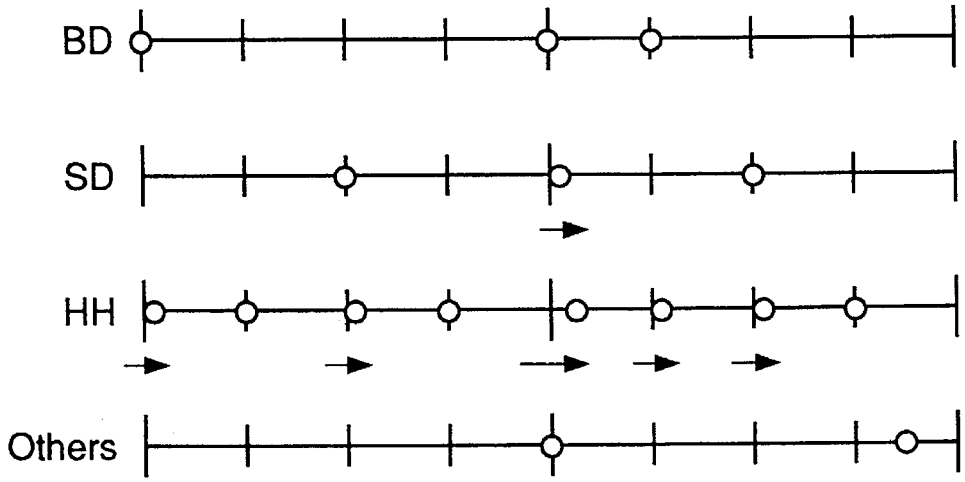

AUTOMATIC PERFORMANCE DEVICE FOR IMPARTING A RHYTHMIC TOUCH TO MUSICAL TONES

BACKGROUND OF THE INVENTION

1. Field of the Invention

This invention relates to an automatic performance device which is capable of imparting rhythmicity of a human touch to musical tones generated during automatic performance.

2. Prior Art

In conventional automatic performance devices, to impart so-called rhythmicity to mechanical musical tones generated during automatic performance, there are known several methods, which include a method of swinging a tempo clock of an automatic performance in a random manner, a method of swinging the tempo clock according to a predetermined function, and a method of shifting backward (delaying) timing for generating a musical tone at a specific beat in one measure by a predetermined amount.

However, any of the above-mentioned conventional methods can provide only limited types of lively rhythmicity, and therefore an automatic performance device which can impart new types of rhythmicity has been desired.

SUMMARY OF THE INVENTION

It is the object of the invention to provide an automatic performance device which is capable of imparting new types of rhythmicity to musical tones generated during automatic performance, which cannot be imparted by conventional automatic performance devices.

According to a first aspect of the invention, there is provided an automatic performance device comprising:

memory means or storing automatic performance data including event data;

playback means for reading out the automatic performance data from the memory means and playing back the automatic performance data for generating musical tones;

detecting means for detecting a plurality of event data which overlap in output timing for generating musical tones, from the automatic performance data read out by the playback means; and control means responsive to an output from the detecting means, for shifting the output timing of at least one of the plurality of event data which overlap in the output timing when the plurality of event data are detected by the detecting means.

Preferably, the automatic performance data comprises automatic performance data corresponding to a plurality of kinds of parts, the control means shifting the output timing of at least part of a plurality of event data detected from the automatic performance data by the detecting means by shift amounts which are different between the plurality of kinds of parts, when the detected plurality of event data overlap in the output timing.

More preferably, the control means ranks the plurality of kinds of parts in a predetermined order, the control means setting shift amounts by which the output timing of the at least part of the plurality of event data are to be shifted, to larger amounts as the event data correspond to lower ranked ones of the plurality of kinds of parts.

Also preferably, the control means is capable of changing a shift amount by which the output timing of the at least one of the plurality of event data is to be shifted.

Advantageously, the automatic performance data comprises automatic performance data corresponding to a plurality of kinds of percussion instruments, the control means imparting different priorities to the plurality of kinds of percussion instruments, and shifting the output timing of event data detected from the automatic performance data corresponding to the plurality of kinds of percussion instruments, according to the priorities imparted to the plurality of kinds of instruments to which the detected event data correspond.

According to a second aspect of the invention, there is provided an automatic performance device comprising:

memory means for storing automatic performance data including event data;

playback means for reading out the automatic performance data from the memory means and playing back the automatic performance data for generating musical tones; and control means for shifting output timing of at least part of the event data of the automatic performance data read out by the playback means, for generating musical tones;

wherein the control means determines a direction in which the output timing of the at least part of the event data is to be shifted, according to a location of the at least part of the event data within a predetermined performance section.

Preferably, the control means divides the predetermined performance section into a former half portion and a latter half portion, and shifts the output timing of event data present in the former half portion in an advancing direction, and the output timing of event data present in the latter half portion in a delaying direction.

More preferably, the predetermined performance section corresponds to one beat.

Preferably, the control means is capable of changing a shift amount by which the output timing of the at least part of the event data is to be shifted.

The above and other objects, features, and advantages of the invention will be more apparent from the following detailed description taken in conjunction with the accompanying drawings.

BRIEF DESCRIPTION OF THE DRAWINGS

FIGS. 9A and 9B are diagrams useful in explaining how tone generating timing is shifted, according to the first embodiment, in which:

FIG. 9A shows tone generating timings of event data before shifting; and

FIG. 9B shows tone generating timings of event data after shifting;

FIGS. 14A and 14B are diagrams useful in explaining how the tone generating timing is shifted, according to the second embodiment, in which:

FIG. 14A shows tone generating timings of event data before shifting; and

FIG. 14B shows tone generating timings of event data after shifting.

DETAILED DESCRIPTION

The invention will now be described in detail with reference to the drawings showing embodiments thereof.

Figure 1:
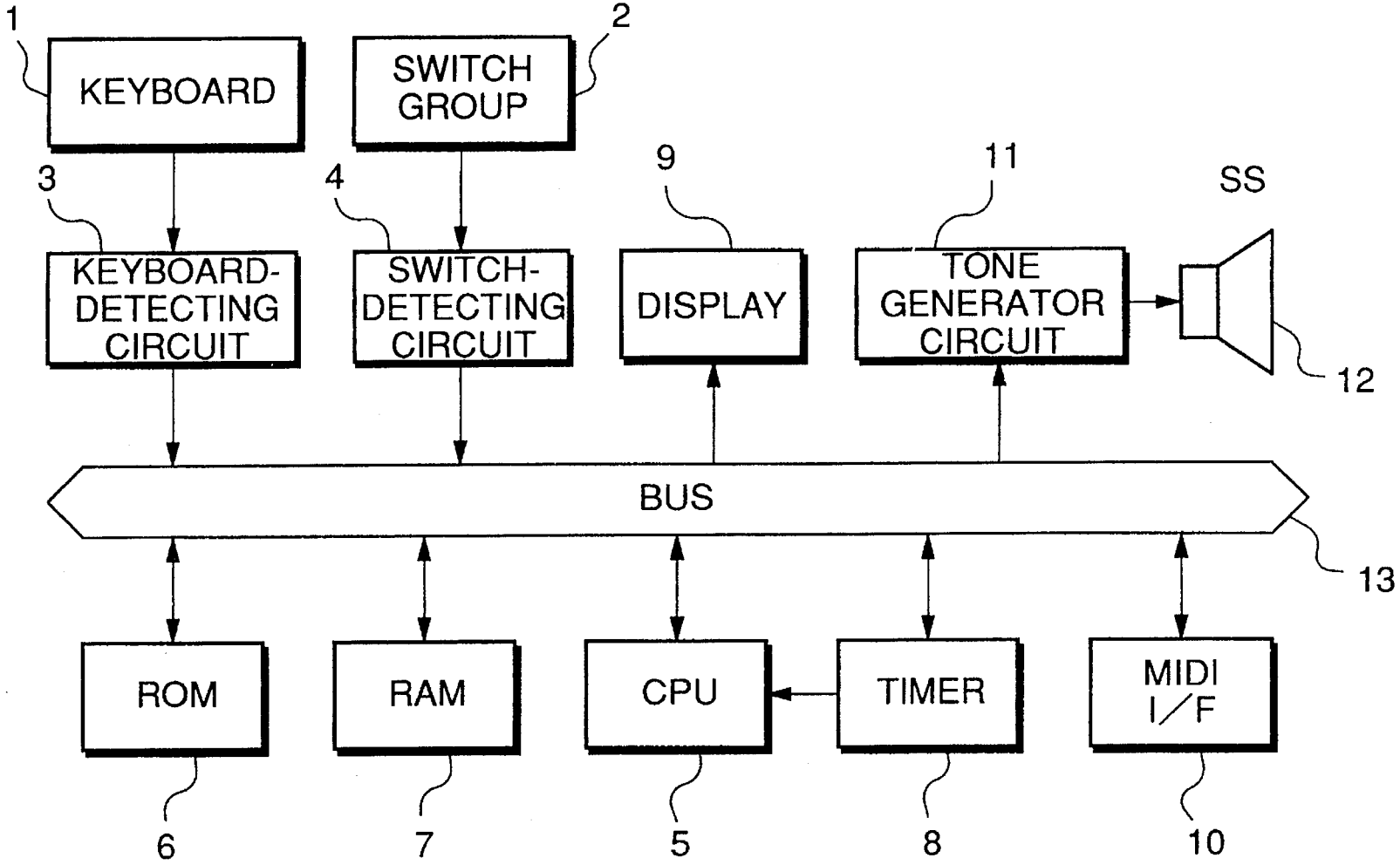
FIG. 1 is a block diagram schematically showing the arrangement of an automatic performance device according to a first embodiment of the invention.

Referring first to FIG. 1, there is schematically illustrated the whole arrangement of an automatic performance device according to a first embodiment of the invention. The present embodiment is an application of the automatic performance device to an electronic rhythm instrument.

As shown in the figure, the automatic performance device according to the present embodiment is comprised of a keyboard 1 for inputting tone pitch information, a switch group 2 for inputting various kinds of information, a keyboard-detecting circuit 3 for detecting key depression of the keyboard 1, a switch-detecting circuit 4 for detecting switching states of the switch group 2, a CUP 5 for controlling the whole operation of the device, a ROM 6 storing control programs to be executed by the CUP 5, table data, etc., a RAM 7 for temporarily storing automatic performance data, various kinds of input information, results of calculations, etc., a timer 8 for timing an interrupting time for a timer interrupt processing, various times or time periods, etc., a display 9 for displaying various kinds of information, etc., an MIDI interface (I/F) 10 for inputting MIDI signals from an external device and outputting MIDI signals to an external device, a tone generator circuit 11 for converting performance data from the keyboard 1, automatic performance data, etc. to musical tone signals, and a sound system 12 formed of a loudspeaker or loudspeakers, etc., for converting the musical tone signals from the tone generator circuit 11 to musical sound.

The above-mentioned component elements 3 to 11 are connected to each other through a bus 13. The timer 8 is connected to the CPU 5, and the tone generator circuit 11 is connected to the sound system 12.

The switch group 2 include start/stop switches for instructing start and stop of automatic performance, UP/DOWN switches for changing a shift amount of tone generating timing for event data of automatic performance data, etc., none of which is shown.

Figure 2:
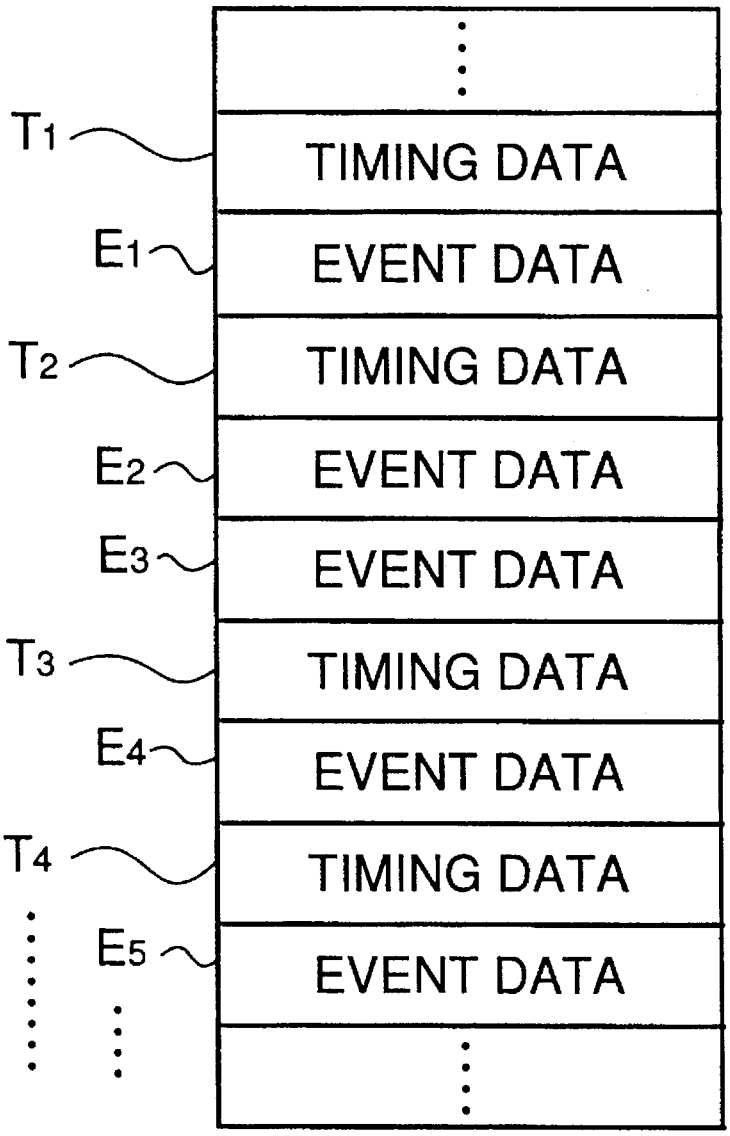
FIG. 2 is a diagram showing a data format of automatic performance data to be used in automatic performance by the automatic performance device according to the first embodiment.

FIG. 2 shows a data format of automatic performance data to be used in automatic performance by the automatic performance device according to the present embodiment.

As shown in the figure, the automatic performance data consist of timing data $T_k$ (k=1 . . . ) and event data $E_1$ (l=1 . . . ).

The timing data $T_k$ indicates a time interval (numerical data) between adjacent event data items. In the present embodiment, the duration of a quarter note is divided by 96, and the resultant duration (hereinafter referred to as "the 384th note duration") is set as a unit time interval, in which the time interval between adjacent event data items is represented. The unit time interval, however, is not limitative but a different duration may be set as the unit time interval. As described hereinafter, the unit time interval represents an interrupt time interval at which the timer interrupt processing is triggered. The actual interrupt time interval represented by the unit time interval changes according to the tempo of the performance.

The event data $E_1$ is comprised of a note number indicative of the kind of a percussion instrument tone to be generated and a velocity indicative of the strength of the percussion instrument tone.

The automatic performance data shown in FIG. 2 which are recorded on one track, and similar automatic performance data to be recorded on four tracks are stored into the RAM 7 in FIG. 1. For example, automatic performance data corresponding to a bass drum (BD) are stored onto a first track, automatic performance data corresponding to a snare drum (SD) onto a second track, automatic performance data corresponding to a hi-hat (HH) onto a third track, and automatic performance data corresponding to others (Others) onto a fourth track, respectively. These stored automatic performance data, which have lengths for example, of one measure or several measures, are repeatedly read out in a well-known manner to be used for performance.

Next, control processings carried out by the automatic performance device constructed as above will be described with reference to flowcharts of FIGS. 3 to 8.

Figure 3:
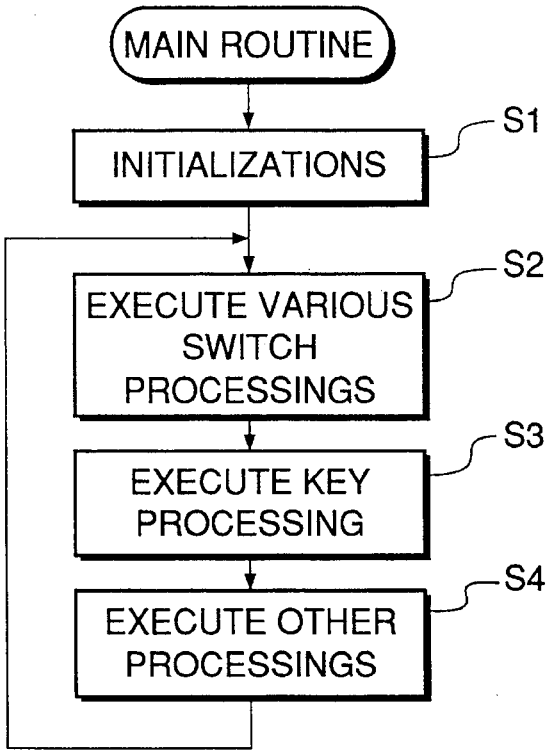
FIG. 3 is a flowchart showing a main routine which is executed by a CPU of the automatic performance device of FIG. 1.

FIG. 3 shows a main routine carried out by the automatic performance device according to the present embodiment, which is executed by the CPU 5 in FIG. 1.

First, initializations, such as clearing of the RAM 7, etc. and clearing of input/output ports, not shown, are executed at a step S1, and various switch processings are carried out in response to operations of respective switches of the switch group 2, at a step S2. Then, a key processing for carrying out sound generation or termination of sound generation in response to key depression of the keyboard 1 is executed at a step S3, and other processings are executed at a step S4, followed by the program returning to the step S2, to thereby repeatedly execute the above-mentioned processings.

Figure 4:
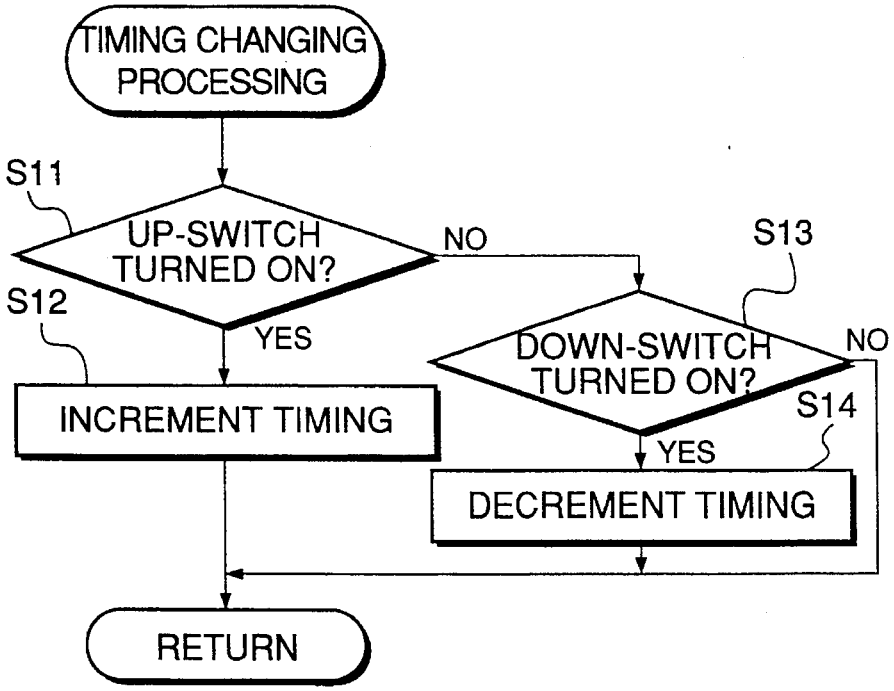
FIG. 4 is a flowchart showing a subroutine for carrying out a timing changing processing, which is part of a processing executed at a step S2 in FIG. 3.

FIG. 4 shows a subroutine for carrying out a timing changing processing, which is part of the switch processings executed at the step S2 in FIG. 3. This subroutine is provided for changing a shift amount of tone generating timing of event data in response to the operation of the UP/DOWN switches.

First, it is determined at a step S11 whether or not the UP switch has been turned on or closed. If the UP switch has been turned on, a soft counter TIMING preset in the RAM 7, for setting the shift amount is incremented by "1" at a step S12, followed by terminating the present subroutine.

On the other hand, if it is determined at the step S11 that the UP switch has not been turned on, then it is determined at a step S13 whether or not the DOWN switch has been turned on. If the DOWN switch has been turned on, the counter TIMING is decremented by "1" at a step S14, followed by terminating the present subroutine. If the DOWN switch has not been turned on, nothing is done (the counter TIMING is neither incremented nor decremented), followed by terminating the present subroutine.

In the present embodiment, the minimum unit amount or time period by which the shift amount can be changed is the aforesaid 384th note duration.

Figure 5:
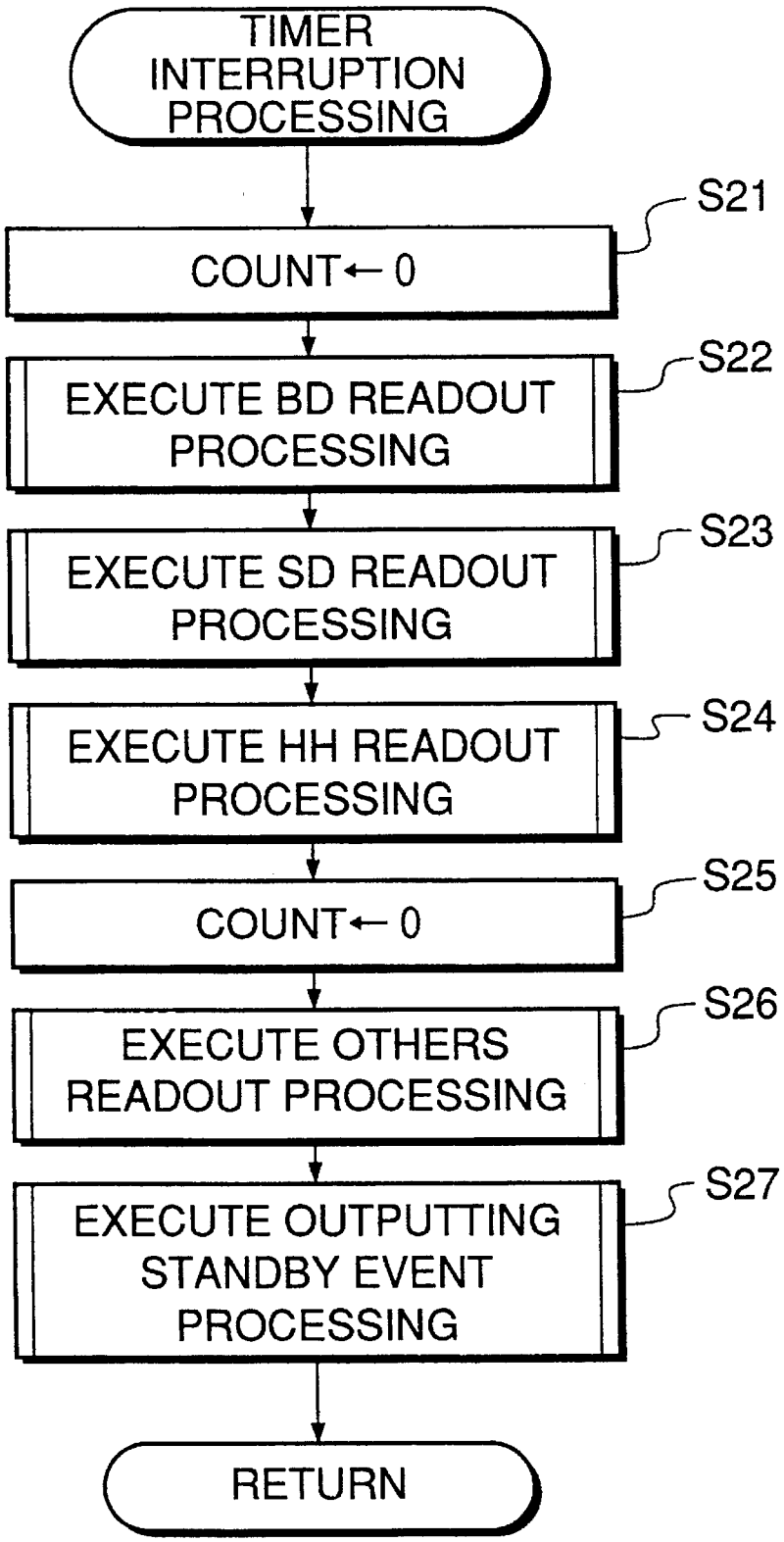
FIG. 5 is a flowchart showing a program for carrying out a timer interrupt processing executed by the CPU in FIG. 1, according to the first embodiment.

FIG. 5 shows details of the timer interrupt processing executed by the CPU 5.

In the present embodiment, a timer interrupt request takes place every 384th note duration by the timer 8 in FIG. 1. That is, whenever the timer 8 counts up a time period corresponding to the 384th note duration, it generates a signal indicative of the timer interrupt request and delivers the same to the CPU 5. Then, the CPU 5 shifts the processing mode from the main routine to the timer interrupt routine in response to the interrupt request. Since the time period corresponding to the 384th note duration changes according to the tempo of the automatic performance, the actual time interval at which the interrupt request is issued changes according to the automatic performance tempo.

In FIG. 5, first, to determine the shift amount of event data, a soft counter COUNT preset in the RAM 7 is reset at a step S21. This soft counter COUNT is provided to determine the shift amount of output timing of event data when a plurality of items of event data with the same or overlapping tone generating timing are present on different tracks. Specifically, the count value of the counter COUNT is used to multiply the count value of the counter TIMING by an integer (a value indicated by the counter COUNT). A manner of determining the shift amount of output timing of event data by the use of the counter COUNT will be described hereinafter.

Then, a subroutine for reading out automatic performance data corresponding to the bass drum (BD) (BD readout processing) is executed at a step S22, and a subroutine for reading out automatic performance data corresponding to the snare drum (SD) (SD readout processing) is executed at a step S23, followed by executing a subroutine for reading out automatic performance data corresponding to the hi-hat (HH) (HH readout processing), at a step S24. These readout processings will be described hereinafter.

Further, the counter COUNT is reset at a step S25, and a subroutine for reading out automatic performance data corresponding to the others (Others readout processing) is executed at a step S26. Then, an outputting standby event processing subroutine is executed at a step S27. This processing is provided for outputting and delivering automatic performance data, which have been read out according to the readout processings and stored into a predetermined buffer, to the tone generator at appropriate timing. After execution of the outputting standby event processing, the present interrupt processing is terminated.

Figure 6:
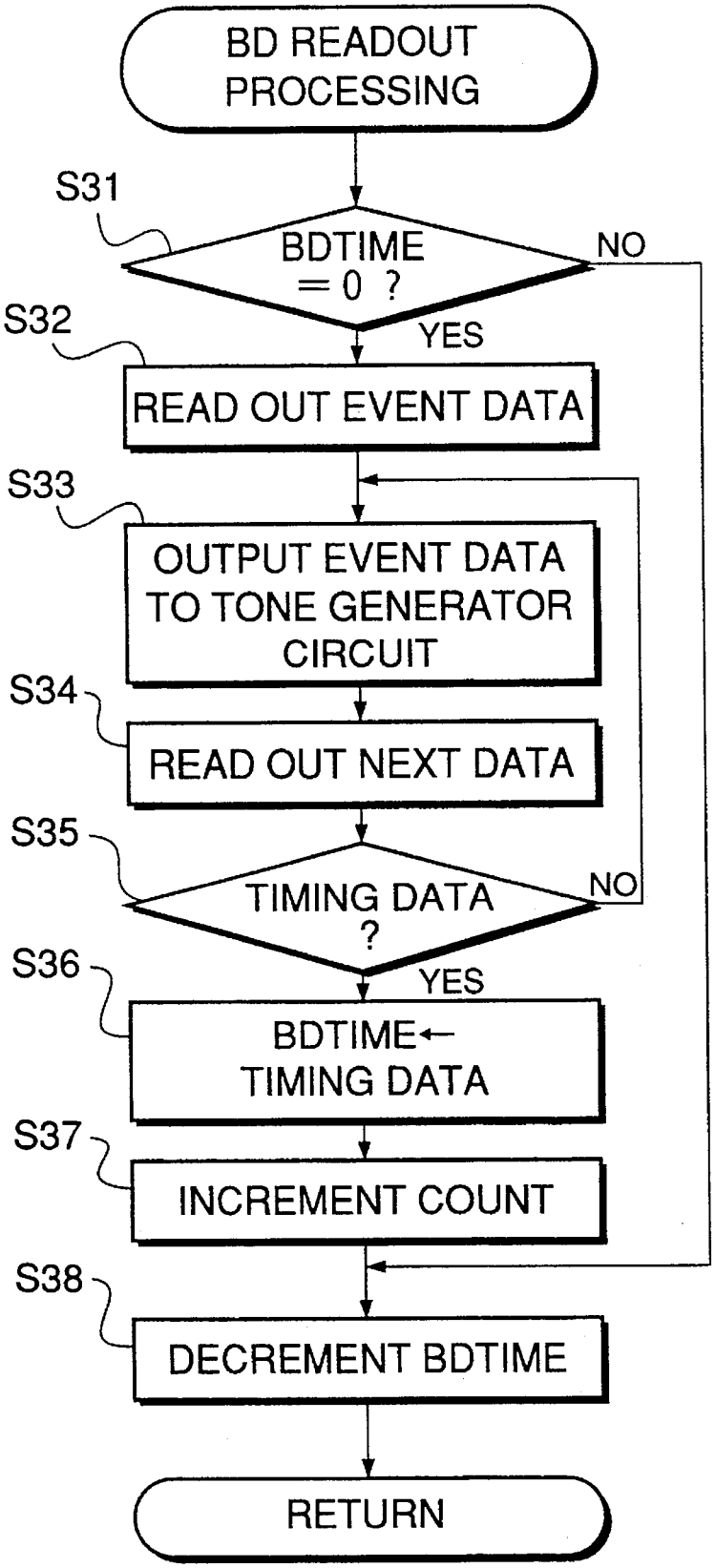
FIG. 6 is a flowchart showing details of a subroutine for a bass drum (BD) readout processing executed at at a step S22 in FIG. 5.

FIG. 6 shows details of the subroutine for the BD readout processing executed at the step S22.

First, it is determined at a step S31 whether or not a soft counter BDTIME preset in the RAM 7 is set to "0". The count value of the counter BDTIME is used to determine timing for reading out event data from the track where automatic performance data corresponding to the buss drum are stored (hereinafter referred to as "the bass drum track"). Specifically, when timing data is read out from the bass drum track, the timing data is set into the counter BDTIME, and then the timing for reading out event data is determined by decrementing the value of the counter BDTIME.

If it is determined at the step S31 that the value of the counter BDTIME is equal to "0", which means that the present time is timing for reading out event data, the event data is read out at a step S32, and then the event data is delivered to the tone generator circuit 11 in FIG. 1, at a step S33, followed by reading out the next data from the bass drum track at a step S34. Then, it is determined at a step S35 whether or not the next read-out data is timing data, and if the data is not timing data, i.e. if it is event data, the program returns to the step S33 to repeatedly carry out the above processing. On the other hand, if it is determined at the step S35 that the next read-out data is timing data, it is set into the counter BDTIME at a step S36, followed by incrementing the value of the counter COUNT by "1" at a step S37. By thus incrementing the value of the counter COUNT, the output timing of event data on another track (snare drum track, high-hat track) is shifted by a predetermined amount if the event data is to be output at the same timing as the event data on the bass drum track.

Then, the value of the counter BDTIME is decremented by "1" at a step S38, followed by terminating the present subroutine.

On the other hand, if it is determined at the step S31 that the value of the counter BDTIME is not equal to "0", i.e. if the present time is not timing for reading out event data, the program jumps to the step S38, wherein the count value of the counter BDTIME is decremented by "1", followed by terminating the present routine.

The automatic performance data readout processing is sequentially carried out, for example, by incrementing a readout pointer, not shown. This readout processing is a well known method, which, however, does not form an essential feature of the present invention, and is therefore not illustrated in the flowchart of FIG. 6. Similarly, the illustration of the readout processing of automatic performance data is omitted in flowcharts showing details of the subroutines executed at the steps S23, S24 and S26, hereinafter described.

Figure 7:
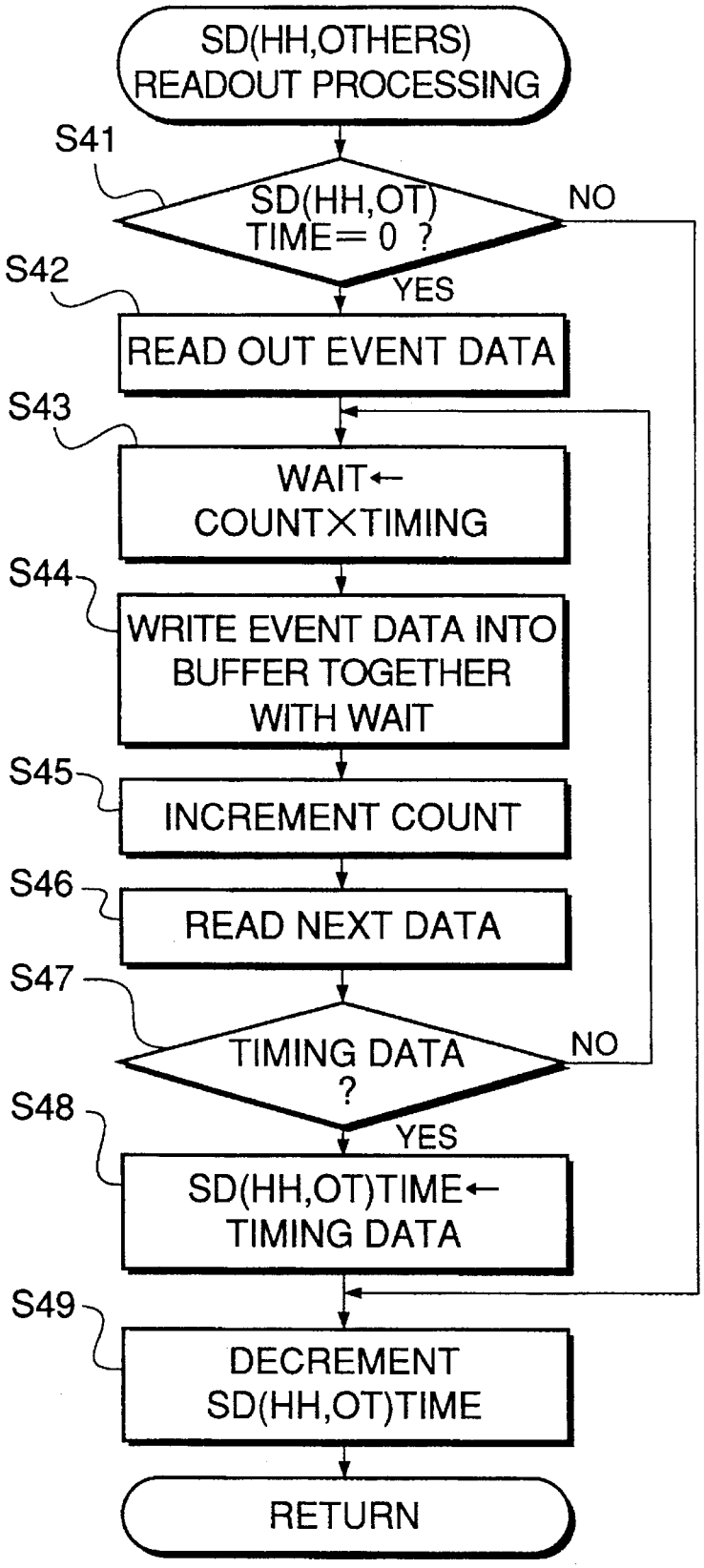
FIG. 7 shows a flowchart showing details of a subroutine for a snare drum (SD) readout processing executed at at a step S23 in FIG. 5.

FIG. 7 shows details of the subroutine for carrying out the SD readout processing executed at the step S23 in FIG. 5. The subroutines for the HH readout processing at the step S24 and for the Others readout processing at the step S26 are similar to the SD readout processing, except that different counters are used in the processings and data are read out from different tracks. Therefore, the other readout subroutines will be described hereinbelow together with the description of the SD readout subroutine. In the description, when the present subroutine is different in processing from the other subroutines, i.e. a counter to be used in the present subroutine is different from ones in the other subroutines, the designations of the counters used in the other subroutines are parenthesized.

In FIG. 7, first, it is determined at a step S41 whether or not a soft counter SDTIME, which is similar in construction and function to the soft counter BDTIME referred to at the step S31 in FIG. 6, is set to "0". If the soft counter SDTIME is set to "0", i.e. if the present time is timing for reading out event data, the event data is read out at a step S42, and the value of the counter COUNT referred to at the step S37 in FIG. 6 is multiplied by the value of the counter TIMING referred to at the step S11 in FIG. 4, and then the resulting product is set into a soft counter WAIT preset in the RAM 7, at a step S43.

Next, the value of the counter WAIT and the event data read out at the step S42 are written into an outputting standby buffer preset in the RAM 7, at a step S44. If any other item of event data (from the same track or from the hi-hat track) to be output at the same timing is stored in the buffer, the value of the counter COUNT is incremented by "1" at a step S45, in order to shift the output timing of the other event data item by a predetermined amount, followed by reading out the next automatic performance data from the snare drum track at a step S46.

Then, it is determined at a step S47 whether or not the data read out at the step S46 is timing data, and if the read-out data is not timing data, the program returns to the step S43 to repeatedly carry out the above processing. On the other hand, if the readout data is timing data, it is set into the counter SDTIME at a step S48, and then the value of the counter SDTIME is incremented by "1" at a step S49, followed by terminating the present subroutine.

Processings of reading out automatic performance data from the other tracks, i.e. the hi-hat track and the others track can be carried out by using, in place of the counter SDTIME employed at the steps S41, S48 and S49, counters HHTIME and OTTIME, respectively, and storing event data read out from the respective tracks into the outputting standby buffer together with the value of the counter WAIT. In the readout processing of automatic performance data from the Others track according to the present embodiment, since the counter COUNT is reset at the step S25 in FIG. 5 before execution of the subroutine for the Others readout processing, as described before, the value of a corresponding counter WAIT to be stored into the outputting standby buffer is equal to "0" in the first loop of execution of the subroutine. When a plurality of items of event data to be output at the same timing are present on the Others track, however, the value of the counter COUNT is incremented according to the number of the event data, and accordingly the event data from the Others track are shifted in output timing by predetermined amounts.

Figure 8:
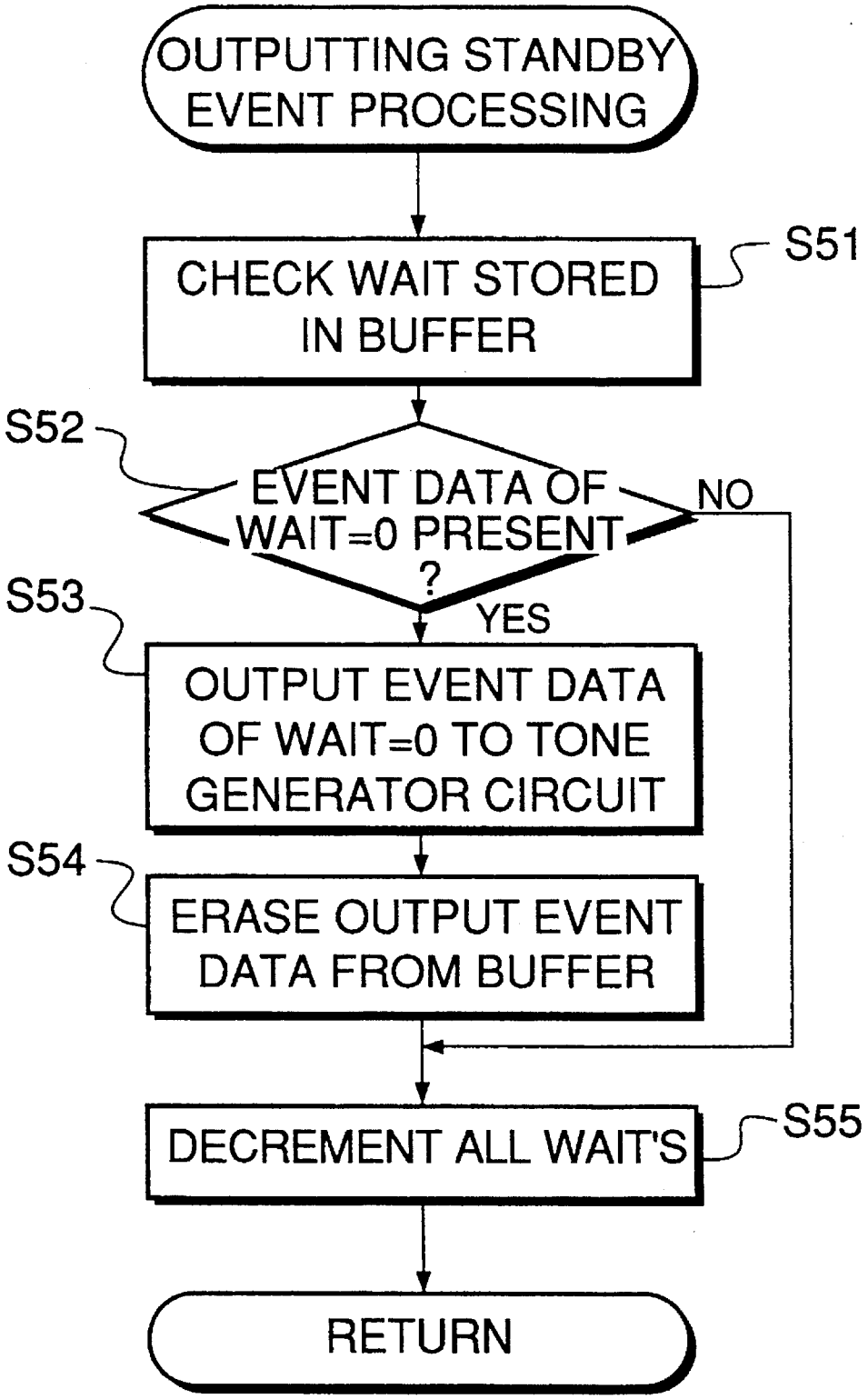
FIG. 8 shows a flowchart showing details of a subroutine for an outputting standby event processing executed at a step S27 in FIG. 5.

FIG. 8 shows details of the subroutine for carrying out the outputting standby event processing executed at the step S27 in FIG. 5.

First, the values of counters WAIT (the number of the counters WAIT is not limited to "1" but corresponds to the number of event data to be stored), which have been stored into the outputting standby buffer together with the event data, are checked one by one at a step S51, and it is determined at a step S52 whether or not there is event data for which the value of the corresponding counter WAIT is equal to "0". If there is such event data, the corresponding event data is output to the tone generator circuit 11 at a step S53, and the event data is erased from the outputting standby buffer at a step S54. In the case where a plurality of items of event data whose corresponding counters WAIT are equal to "0" are stored in the outputting standby buffer at the same time, all the plurality of items of event data are simultaneously output to the tone generator circuit 11. On the other hand, if it is determined at the step S52 that there is no event data for which the value of the corresponding counter WAIT is equal to "0", the program skips over the steps S52 and S53 to a step S55.

At the step S55, the values of all the counters WAIT of the event data stored in the outputting standby buffer are decremented by "1", followed by terminating the present subroutine.

FIGS. 9A and 9B show how the tone generating timing is shifted according to the present embodiment, wherein FIG. 9A shows output timing of event data before shifting, and FIG. 9B output timing of event data after shifting.

In FIG. 9A, there are shown event data items $e_1$ to $e_{14}$, of which event data items $e_1$ and $e_2$, $e_3$ to $e_6$, $e_7$ and $e_8$, $e_9$ and $e_{10}$, and $e_{11}$ and $e_{12}$ are set so as to be output at the same timing. After the control processing according to the present embodiment is effected on these automatic performance data read out from the tracks, the timings for outputting the event data are changed as shown in FIG. 9B.

More specifically, the event data items $e_2$, $e_4$, $e_8$, $e_{10}$ and $e_{12}$ are delayed in output timing by a shift amount designated by the UP/DOWN switches of the switch group 2 relative to the original timing, and the event data item $e_5$ is delayed in output timing by the same shift amount relative to the above delayed timing, i.e. by double the above shift amount relative to the original timing. However, the event data item $e_6$ is output at the same timing as the original timing, for the reason mentioned before. However, if another event data item to be output at the same timing as the timing of the event data item $e_6$ is present on the others track, the former is delayed in output timing.

As described above, according to the present embodiment, when event data stored on a predetermined track is to be output at the same timing as event data on other track(s), the event data on the other track(s) are delayed in output timing by a predetermined amount. As a result, rhythmicity of a human touch can be imparted to musical tones generated during automatic performance, which cannot be attained by any conventional device. That is, in musical performance performed by a human being, although he intends to generate a plurality of musical tones at the same timing, usually the musical tones are generated with slight variations in timing. According to the present embodiment, human characteristics can be imparted to musical tones generated during automatic performance.

According to the present embodiment, even when a plurality of items of event data are present on the bass drum track to be output at the same timing, they are not shifted in output timing. However, alternatively, second event data et seq. on the bass drum track may be shifted in output timing by predetermined amounts, similarly to event data on the snare drum track, hi-hat track, and Others track. Further, according to the embodiment, when event data on the bass drum track and event data on other tracks are to be output at the same timing, the event data on the bass drum track is not shifted in output timing at all. However, event data on the bass drum track may be shifted in output timing while event data on other tracks are not shifted at all.

According to the present embodiment, when a plurality of items of event data are to be output at the same timing, the shift amount of first event data is set to "0", that of second event data to "1× the value of the counter TIMING", that of third event data to "2× the value of the counter TIMING", . . . However, this is not limitative, but the event data may be shifted in different manners. For example, they may be shifted in a random manner. Besides, although according to the present embodiment, the shift amount is set based on the minimum readout unit time period, i.e. interrupt time interval, however, it may be set based on a shorter unit time period or a longer unit time period.

Further, the manner of shifting the output timing may be varied depending upon locations of event data, e.g. the output timing may be shifted only when event data to be output at the same timing are present at the beginning of one beat. Besides, the shifting direction may not be limitative to the delaying direction but it may be the advancing direction. Alternatively, it may be both the delaying direction and the advancing direction which are selected depending upon locations of event data.

Next, description will be made of an automatic performance device according to a second embodiment of the invention.

The present embodiment is distinguished from the first embodiment described above only in the manner of shifting the output timing of event data. Therefore, the present embodiment can be realized by employing the same arrangement of the automatic performance device of FIG. 1 and the same main routine of FIG. 3 employed in the first embodiment, and by using an interrupt processing of which flowcharts are shown in FIGS. 10 to 13B. Further, in the second embodiment, event data on all the tracks are subjected to the same processing.

Control processings carried out by the automatic performance device according to the present embodiment will be described with reference to the flowcharts of FIGS. 10 to 13B and a diagram of FIG. 14 useful in explaining how the output timing of event data is changed.

Figure 10:
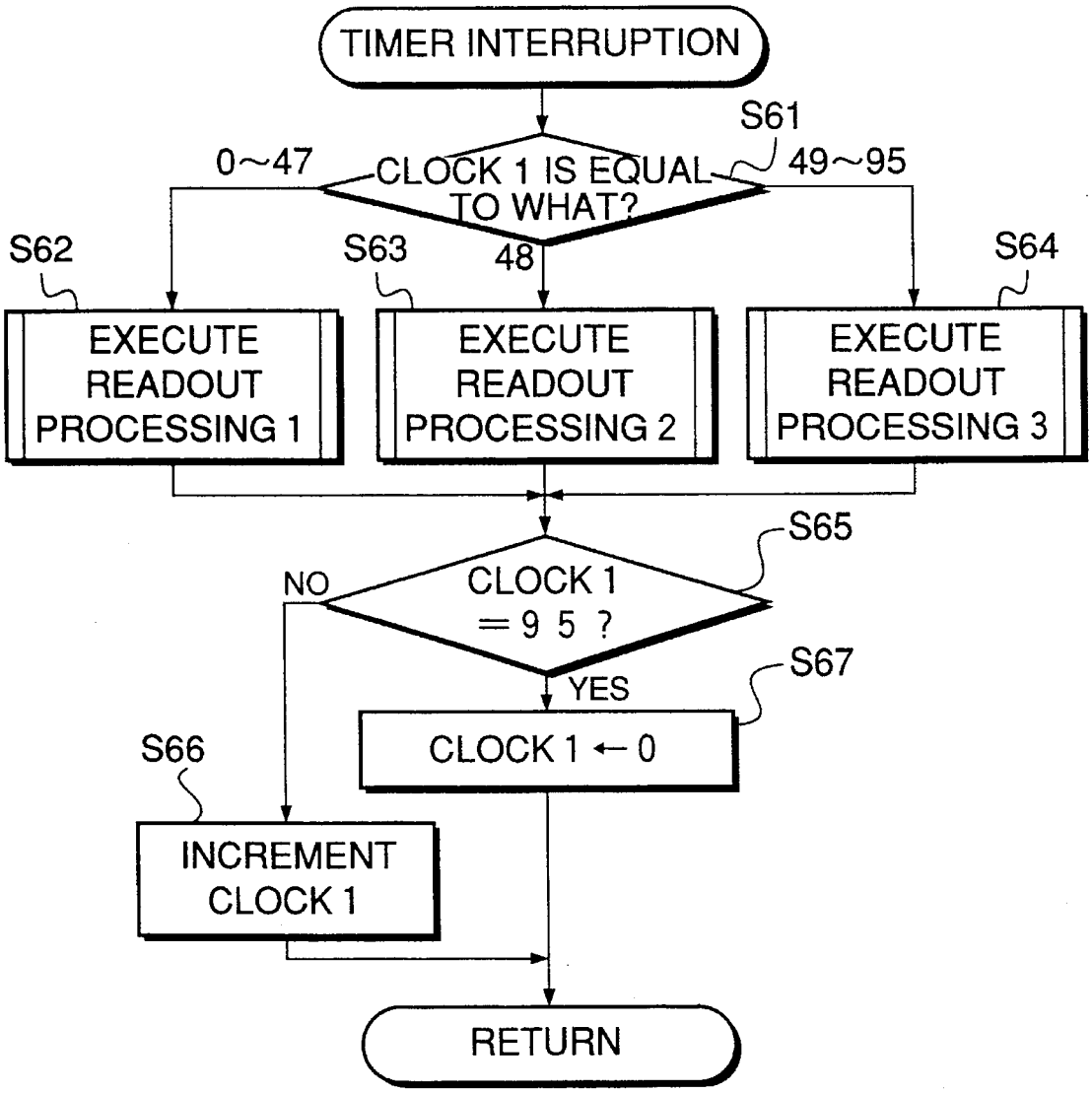
FIG. 10 is a flowchart showing a program for carrying out a timer interrupt processing executed by the CPU in FIG. 1, according to a second embodiment of the invention.

FIG. 10 shows an interrupt processing which is executed by the CPU 5 of the present embodiment, every 384th note duration, similarly to the interrupt processing of FIG. 5.

First, at a step S61 the value of a soft counter CLOCK1 is checked, which is preset in the RAM 7 in FIG. 1, for counting the location of event data within one beat. If the counter value is within a range of 0 to 47, i.e. if the event data is present in the first half of the beat, a readout processing 1 subroutine, described hereinafter, is executed at a step S62. If the counter value is equal to "48", i.e. if the event data is present at the midpoint of one beat, a readout processing 2 subroutine, described hereinafter, is executed at a step S63. If the counter value is within a range of 49 to 95, i.e. if the event data is present in the latter half of the beat, a readout processing 3 subroutine, described hereinafter, is executed at a step S64.

Figures 14A, 14B:
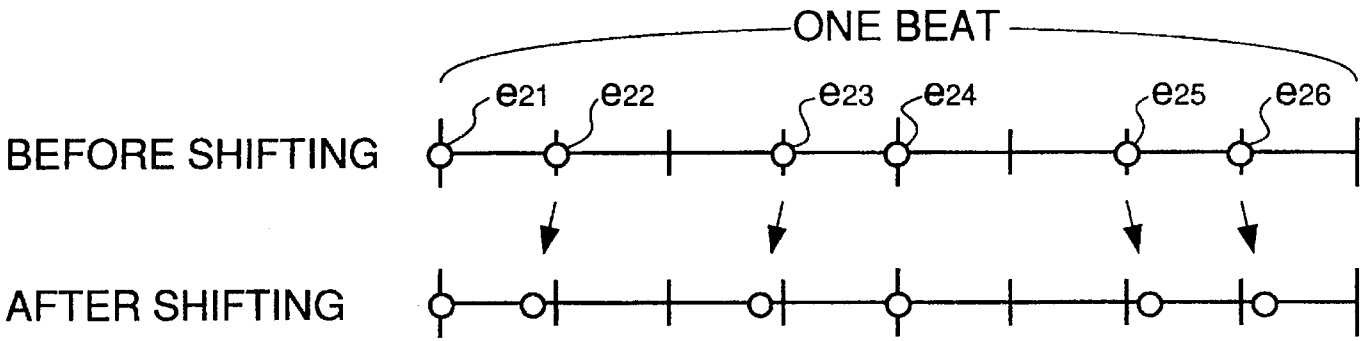

Then, it is determined at a step S65 whether or not the value of the counter CLOCK1 is equal to "95", i.e. whether or not counting for one beat has been completed, and if the value of the counter CLOCK1 is not equal to "95", i.e. if counting for one beat has not been completed. If the value of the counter CLOCK1 is incremented by "1", at a step S66, followed by terminating the present subroutine. On the other hand, if the value of the counter CLOCK1 is equal to "95", i.e. if counting for one beat has been completed, the value of the counter CLOCK1 is reset at a step S67, followed by terminating the present subroutine. FIGS. 14A and 14B show output timing of automatic performance data, wherein FIG. 14A shows output timing of event data before shifting, while FIG. 14B shows output timing of event data after shifting.

The readout processing 1 is provided for shifting the output timing of event data present in the first half of one beat of a musical tone. Specifically, in the readout processing 1, event data items $e_{22}$ and $e_{23}$ present in the first half of one beat other than an event data item $e_{21}$ at the starting point of one beat have output timing thereof shifted in the advancing direction to desired timing, i.e. by a shift amount set in FIG. 4 of the first embodiment (value stored in the counter TIMING) and output to the tone generator circuit 11.

The readout processing 2 is for shifting the output timing of event data present at the midpoint of one beat. Specifically, in the readout processing 2, event data $e_{24}$ is output to the sound generator circuit 11 without output timing thereof being shifted.

The readout processing 3 is for shifting the output timing of event data present in the latter half of one beat. Specifically, in the readout processing 3 event data items $e_{25}$ and $e_{26}$ have output timing thereof delayed to desired timing and output to the tone generator 11.

Figure 11A:
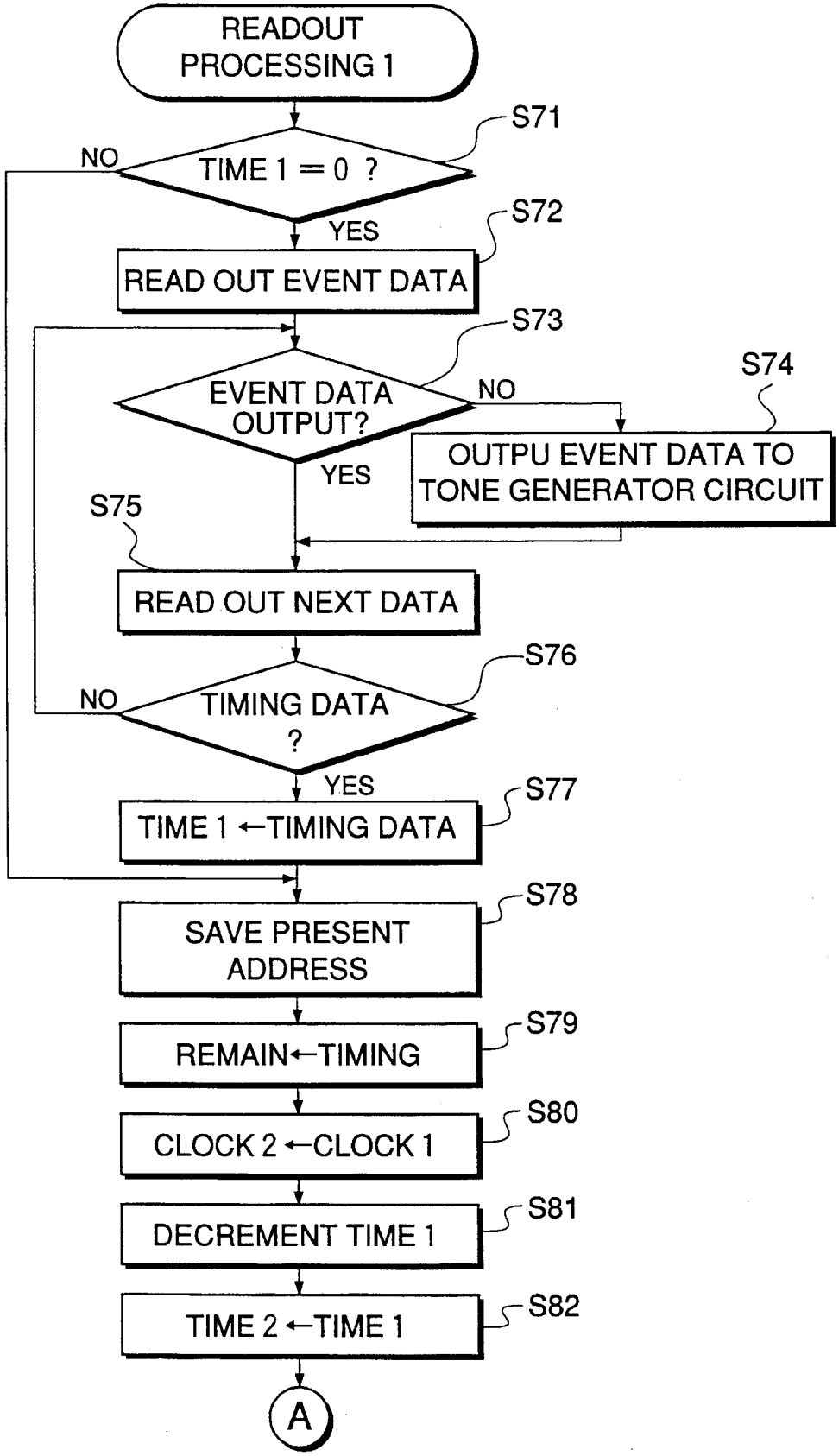
FIG. 11A is a flowchart showing details of a subroutine for an event data readout processing 1 executed at a step S62 in FIG. 10.
Figure 11B:
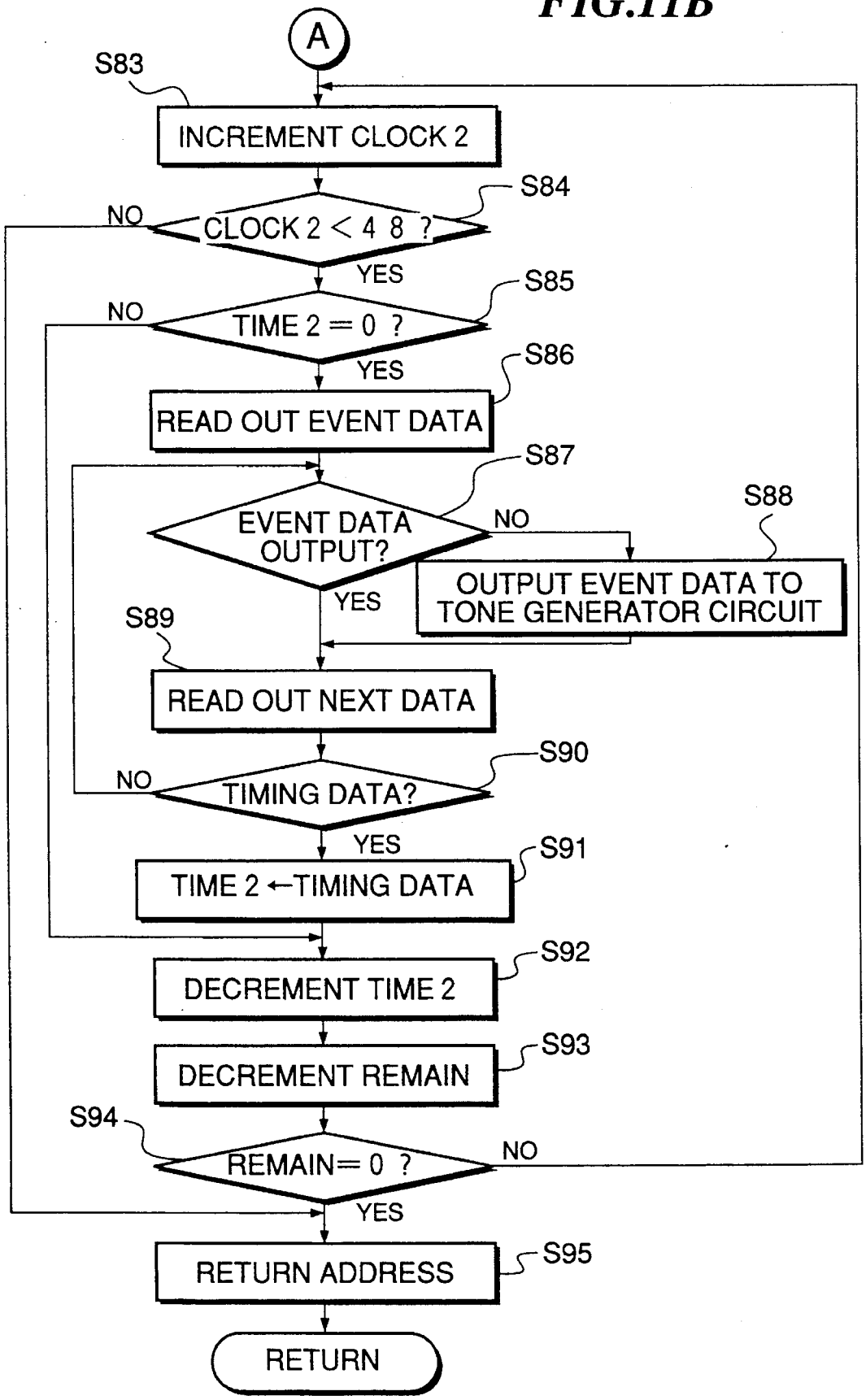
FIG. 11B is a continued part of the flowchart of FIG. 11A.

FIGS. 11A and 11B show details of the readout processing 1 subroutine. In this subroutine, event data to be shifted in output timing are read out in advance in order to advance the output timing of event data such as the data items $e_{22}$ and $e_{23}$ to desired timing.

In FIG. 11A, first, it is determined at a step S71 whether or not the value of a soft counter TIME1 preset in the RAM 7 is equal to "0". The counter TIME1 counts a time interval between adjacent two event data items, similarly to the counter BDTIME employed in the first embodiment.

If it is determined at the step S71 that the value of the counter TIME1 is equal to "0", i.e. if the present time is timing for reading out event data, the event data stored in the RAM 7 is read out at a step S72, and then it is determined at a step S73 whether or not the event data has already been output. If the event data has not been output yet, it is output to the tone generator circuit 11 in FIG. 1, at a step S74, whereas if it has been output (the state where the event data has been output will be described hereinafter), nothing is done, and the next data is read out at a step S75. Then, it is determined at a step S76 whether or not the read-out data is timing data, and if it is not timing data, i.e. if a plurality of event data items to be output at the same output timing are stored, the program returns to the step S73, and the above processing is repeatedly executed. On the other hand, if the read-out data is timing data, it is set into the counter TIME1 at a step S77.

Then, an address from which data is being read out from the present track, i.e. an address indicated by a readout pointer is saved at a step S78. In the present embodiment, similarly to the first embodiment, the readout pointer is employed for sequentially reading out automatic performance data, and this is the reason why the processing at the step S78 is required.

Then, the value of the counter TIMING referred to in FIG. 4 of the first embodiment is set into a soft counter REMAIN preset in the RAM 7, at a step S79. The count value of the counter REMAIN indicates a remaining timing range representing a difference between the original timing and advanced timing at which event data is to be read out in advance. The counter REMAIN is first set to a predetermined shift amount, i.e. the value of the counter TIMING, at a step S79.

Then, the value of the counter CLOCK1 is set into a soft counter CLOCK2 preset in the RAM 7, at a step S80. The counter CLOCK2, similarly to the counter CLOCK1, counts the location of event data to be read out within one beat when event data is read out in advance.

Next, the value of the counter TIME1 is decremented by "1" at a step S81, and the decremented value is set into a soft counter TIME2 preset in the RAM 7 at a step S82. The counter TIME2, similarly to the counter TIME1, counts the remaining time period before reading-out of the next event data during reading-out of event data in advance.

Then, the value of the counter CLOCK2 is incremented by "1" at a step S83 in FIG. 11B. Then, it is determined at a step S84 whether or not the value of the counter CLOCK2 is smaller than "48". If the value of the counter CLOCK2 is smaller than "48", i.e. if the location of event data to be read out in advance has not reached the midpoint of one beat, it is determined at a step S85 whether or not the value of the counter TIME2 is equal to "0", i.e. whether or not the present time is timing for reading out event data.

If it is determined at the step S85 that the value of the counter TIME2 is equal to "0", which means that the present time is timing for reading out event data, the event data is read out at a step S86. Processings executed at subsequent steps S87 to S90 are similar to the steps S73 to S76, and therefore description thereof is omitted.

Then, timing data read out at the step S89 is set into the counter TIME2 at a step S91, and the values of the counter TIME2 and the counter REMAIN are decremented by "1" at steps S92 and S93, respectively.

On the other hand, if it is determined at the step S85 that the value of the counter TIME2 is not equal to "0", which means that the event data is not to be read out at the present time, the program skips over the steps S86 to S91 to the step S92.

At the following step S94, it is determined whether or not the value of the counter REMAIN is equal to "0". If the value of the counter REMAIN is equal to "0", i.e. if the end of the remaining timing range for reading out event data in advance has been reached, the address saved at the step S78 is returned to the readout pointer at a step 95, followed by terminating the present routine. On the other hand, if the value of the counter REMAIN is not equal to "0", which means that the end of the remaining timing range has not been reached, the program returns to the step S83, followed by repeatedly executing the above processing.

On the other hand, if it is determined at the step S84 that the value of the counter CLOCK2 is equal to "48", i.e. if the location of event data to be read out is in the latter half of one beat, the program skips over the steps S85 to S94 to the step S95.

As described above, in the first half of one beat, event data present at subsequent locations within the first half of the beat are read out in advance and output to the tone generator circuit 11, and therefore the aforesaid "state where the event data has already been output" occurs. To prevent repeated outputting of the same event data, the data "which has already been output" is not output again when it is read out.

Figure 12:
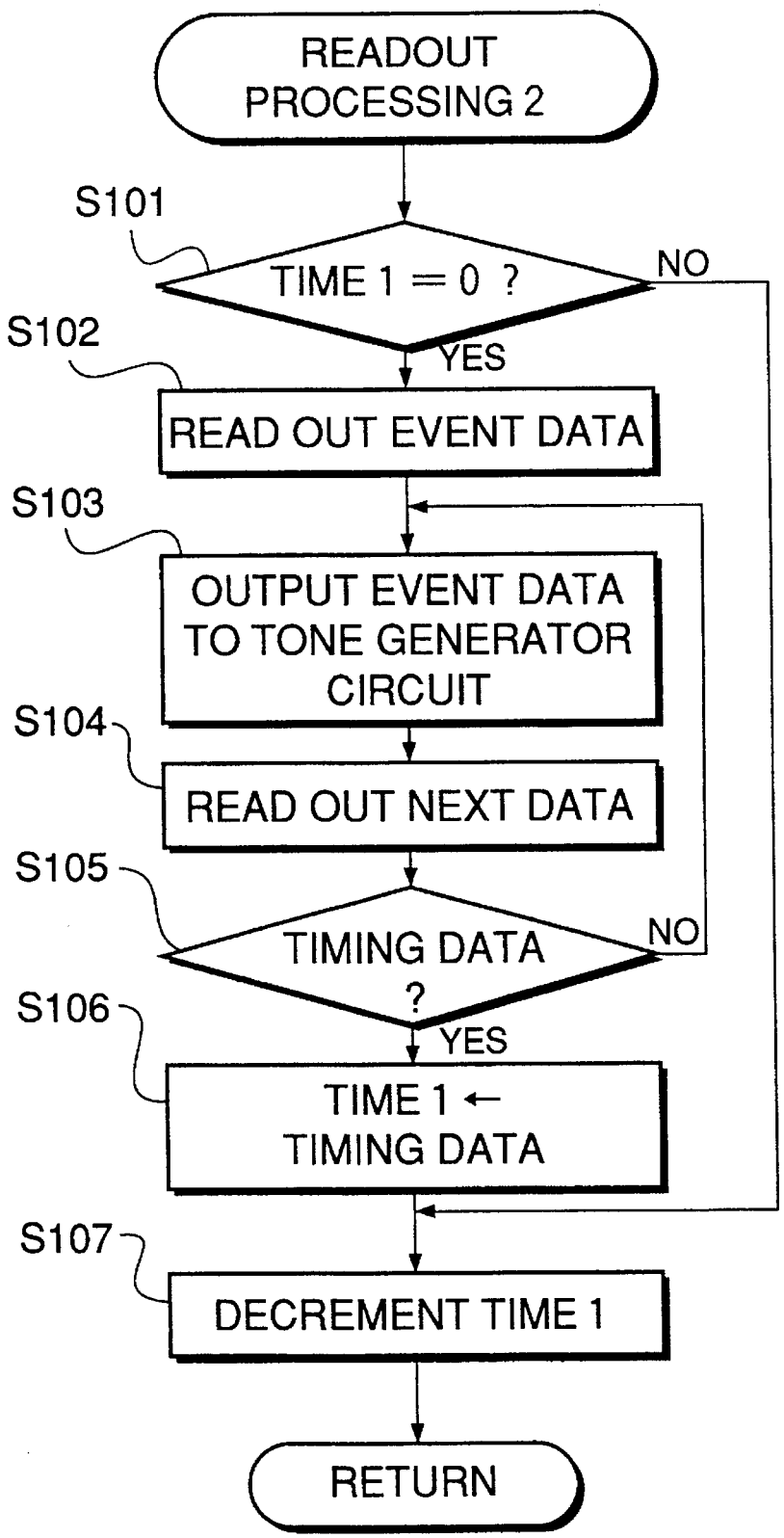
FIG. 12 is a flowchart showing details of a subroutine for an event data readout processing 2 executed at a step S63 in FIG. 10.

FIG. 12 shows details of the readout processing 2 subroutine executed at the step S63 in FIG. 10. The present subroutine is for outputting the event data item $e_{24}$ in FIG. 14 to the tone generator circuit 11 without output timing thereof being shifted, as mentioned before.

Steps S101 to S107 of the present subroutine correspond to the steps S31 to S36 and S38 in the BD readout processing described with reference to FIG. 6 of the first embodiment. The present embodiment is distinguished from the first embodiment only in that the counter BDTIME at the steps S31, S36 and S38 is replaced by the counter TIME1. Therefore, description of the steps S101 to S107 is omitted.

Figure 13A:
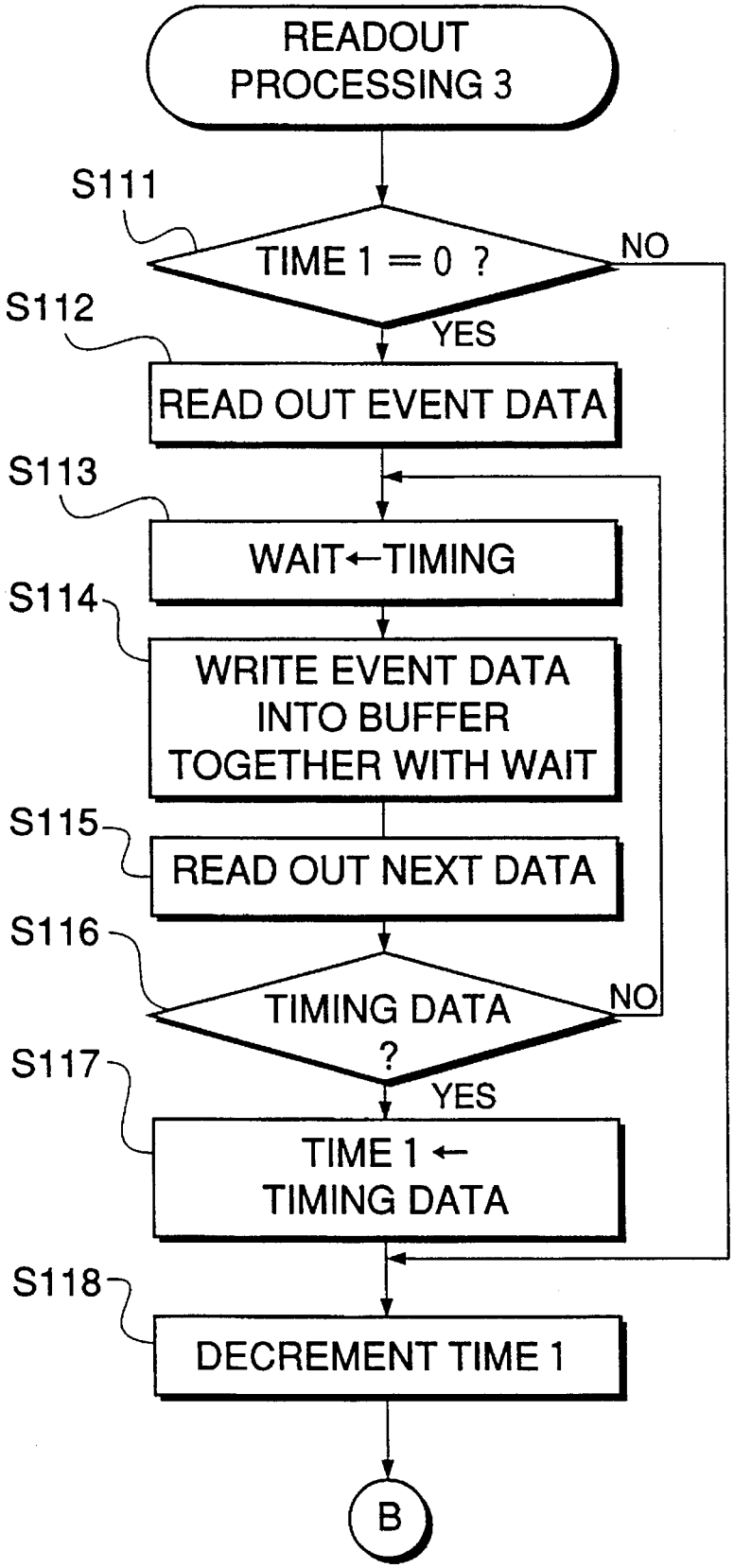
FIG. 13A is a flowchart showing details of a subroutine for an event data readout processing 3 executed at a step S64 in FIG. 10.
Figure 13B:
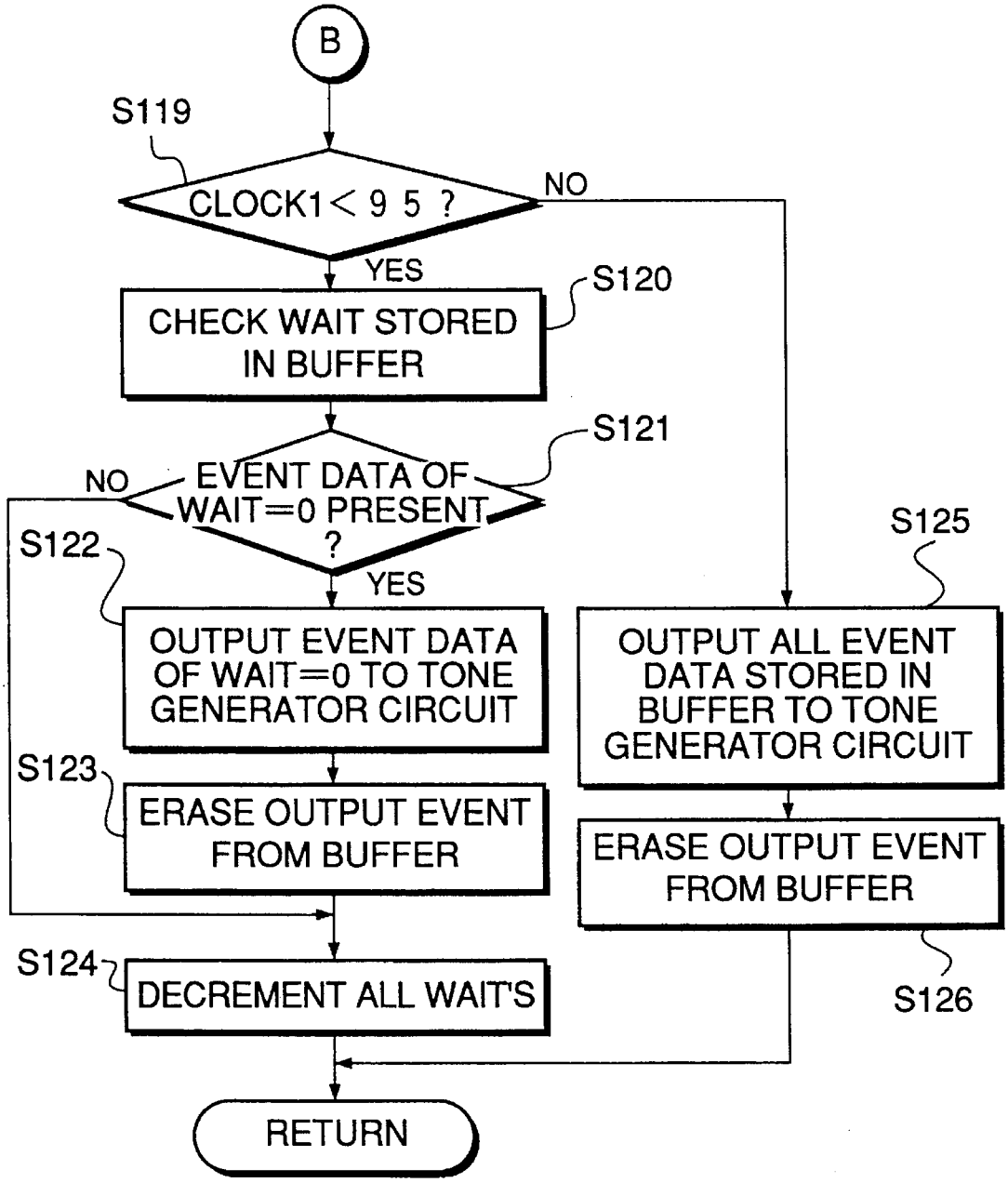
FIG. 13B is a continued part of the flowchart of FIG. 13A.

FIG. 13A and 13B show details of the readout processing 3 subroutine executed at the step S64 in FIG. 10. The present subroutine is for outputting the event data items $e_{25}$ and $e_{26}$ in FIG. 14 to the tone generator circuit 11 with output timing thereof being shifted to desired timing.

First, it is determined at a step S111 whether or not the value of the counter TIME1 is equal to "0". If the value of the counter TIME1 is equal to "0", i.e. if the present time is timing for reading out event data, the event data is read out at a step S112, and the value of the counter TIMING is set into a counter WAIT similar to the counter WAIT employed at the step S43 in FIG. 7 of the first embodiment, at a step S113. Processings executed at subsequent steps S114 to S116 are similar to the steps S44, S46 and S47 in FIG. 7, and therefore description thereof is omitted.

If it is determined at the step S116 that the read-out data is timing data, the timing data is set into the counter TIME1 at a step S117, and the value of the counter TIME1 is decremented by "1" at a step S118. Then, it is determined at a step S119 in FIG. 13B whether or not the value of the counter CLOCK1 is smaller than "95", i.e. whether or not the event data to be read out is located at the end of one beat, at a step S119. If the value of the counter CLOCK1 is smaller than "95", i.e. if the reading-out location has not reached the end of one beat, the program proceeds to a step S120. Processings to be executed at subsequent steps S120 to S124 are similar to the steps S51 to S55, of the outputting standby event processing in FIG. 8 of the first embodiment, and therefore description thereof is omitted.

On the other hand, if it is determined at the step S119 that the value of the counter CLOCK1 is equal to "95", i.e. the reading-out location has reached the end of one beat, all the event data stored in the buffer are output to the tone generator circuit 11 to sound musical tones of all the event data delayed in output timing within the present beat, at a step S125, and the output event data are erased from the buffer at a step S126, followed by terminating the present subroutine.

As described above, according to the present embodiment, event data of automatic performance data stored on tracks are shifted forward or backward in output timing or not shifted in output timing, depending upon the location of the event data. Therefore, a new type of rhythmicity which is different from the rhythmicity attained by the first embodiment can be imparted to musical tones generated during automatic performance.

Although in the present embodiment, event data on all the tracks have output timing thereof shifted in the same manner, alternatively only event data on desired track(s) may be shifted in output timing. For example, event data on the tracks corresponding to a drum set, i.e. tracks corresponding to bass drum, snare drum, and hi-hat, are outputted as they are without output timing thereof being shifted, while only event data on a track corresponding to Latin percussion, i.e. Others, may be shifted in output timing.

Further, although in the present embodiment, the shift amount of timing for outputting event data is the same between the first half of one beat before the midpoint and the latter half after the midpoint, the shift amount of event data in the first half may be different from that in the latter half. Furthermore, the shift amount may be varied in dependence on the location of event data in the first half of one beat as well as in the latter half thereof. For example, the shift amount may be set to a larger value as the location of event data is closer to beat timing.

In the first and second embodiments described above, the invention is applied to automatic rhythm performance. However, this is not limitative, but the invention may be applied to any other type of automatic performance.

Further, according to the first and second embodiments, an algorithm for shifting the output timing of event data is employed, which shifts the output timing of event data when the event data are read out. However, this is not limitative, but for example, automatic performance data including event data with previously shifted output timing may be prepared beforehand, and the event data of the automatic performance data may be output as they are read out in a conventional manner.

Further, although in the first and second embodiments, data are recorded on four tracks, i.e. bass drum track, snare drum track, hi-hat track and Others track, a plurality of kinds of automatic performance data may be recorded onto a single track. Besides, the number of tracks employed is not limited to four but may be any other number.

What is claimed is:

1. An automatic performance device comprising:

memory means for storing automatic performance data including event data;

playback means for reading out said automatic performance data from said memory means and playing back said automatic performance data for generating musical tones;

detecting means for detecting a plurality of event data having a simultaneous start time for generating musical tones from said automatic performance data read out by said playback means; and control means responsive to an output from said detecting means, for shifting an output timing of at least one of said plurality of event data having a simultaneous start time when said plurality of event data are detected by said detecting means.

2. An automatic performance device as claimed in claim 1, wherein said automatic performance data comprises automatic performance data corresponding to a plurality of kinds of parts, said control means shifting said output timing of at least part of a plurality of event data detected from said automatic performance data by said detecting means by shift amounts which are different between said plurality of kinds of parts, when said detected plurality of event data overlap in said output timing.

3. An automatic performance device as claimed in claim 2, wherein said control means ranks said plurality of kinds of parts in a predetermined order, said control means setting shift amounts by which said output timing of said at least part of said plurality of event data are to be shifted, to larger amounts as said event data correspond to lower ranked ones of said plurality of kinds of parts.

4. An automatic performance device as claimed in claim 1, wherein said control means is capable of changing a shift amount by which said output timing of said at least one of said plurality of event data is to be shifted.

5. An automatic performance device as claimed in claim 1, wherein said automatic performance data comprises automatic performance data corresponding to a plurality of kinds of percussion instruments, said control means imparting different priorities to said plurality of kinds of percussion instruments, and shifting said output timing of event data detected from said automatic performance data corresponding to said plurality of kinds of percussion instruments, according to said priorities imparted to said plurality of kinds of instruments to which said detected event data correspond.

6. An automatic performance device comprising:

memory means for storing automatic performance data including event data;

playback means for reading out said automatic performance data from said memory means and playing back said automatic performance data for generating musical tones; and control means for shifting output timing of at least part of said event data of said automatic performance data read out by said playback means, for generating musical tones;

wherein said control means determines a direction in which said output timing of said at least part of said event data is to be shifted, according to a location of said at least part of said event data within a predetermined performance section.

7. An automatic performance device as claimed in claim 6, wherein said control means divides said predetermined performance section into a former half portion and a latter half portion, and shifts said output timing of event data present in said former half portion in an advancing direction, and said output timing of event data present in said latter half portion in a delaying direction.

8. An automatic performance device as claimed in claim 7, wherein said predetermined performance section corresponds to one beat.

9. An automatic performance device as claimed in claim 6, wherein said control means is capable of changing a shift amount by which said output timing of said at least part of said event data is to be shifted.

10. A method of performing automatic performance, comprising the steps of:

storing automatic performance data including event data;

reading said automatic performance data stored and playing back said read automatic performance data for generating musical tones;

detecting a plurality of event data having a simultaneous start time for generating musical tones from said read automatic performance data; and shifting an output timing of at least one of said plurality of event data having a simultaneous start time when said plurality of event data having a simultaneous start time are detected.

11. A method of performing automatic performance, comprising the steps of:

(1) storing automatic performance data including event data;

(2) reading out said automatic performance data stored and playing back said automatic performance data read out, for generating musical tones; and (3) shifting output timing of at least part of said event data of said automatic performance data read out, for generating musical tones;

wherein a direction in which said output timing of said at least part of said event data is to be shifted is determined according to a location of said at least part of said event data within a predetermined performance section.

* * * * *